United States Patent [19]

Shekleton et al.

[11] Patent Number: 5,009,589

[45] Date of Patent: Apr. 23, 1991

[54] STORED ENERGY COMBUSTOR FUEL INJECTION SYSTEM

[75] Inventors: Jack R. Shekleton, San Diego; Robert W. Smith, Lakeside, both of Calif.

[73] Assignee: Sundstrand Corporation, Rockford, Ill.

[21] Appl. No.: 447,599

[22] Filed: Dec. 8, 1989

[51] Int. Cl.[5] ..... F23M 9/00

[52] U.S. Cl. ..... 431/183; 431/351; 60/748; 239/400; 239/404

[58] Field of Search ..... 60/748; 431/183, 184, 431/182, 351; 239/400, 404

[56] References Cited

U.S. PATENT DOCUMENTS

| | | | |
|---|---|---|---|
| 1,402,749 | 1/1922 | Du Pont . | |
| 1,567,482 | 12/1925 | Anthony | 239/404 |
| 2,020,778 | 11/1935 | Gregg . | |
| 2,320,575 | 6/1943 | Dunn | 431/183 |
| 3,049,173 | 8/1962 | Costello et al. | 431/184 |
| 3,608,831 | 9/1971 | Place et al. . | |
| 3,695,817 | 10/1972 | Sharan | 431/182 |
| 3,800,531 | 4/1974 | Sharpe . | |
| 3,937,011 | 2/1976 | Caruel et al. . | |
| 3,946,552 | 3/1976 | Weinstein et al. | 239/400 |
| 3,979,069 | 9/1976 | Garofalo | 239/400 |
| 4,005,572 | 2/1977 | Giffhorn . | |
| 4,343,147 | 8/1982 | Shekleton . | |
| 4,343,148 | 8/1982 | Shekleton . | |
| 4,373,325 | 2/1983 | Shekleton . | |
| 4,470,262 | 9/1984 | Shekleton . | |

*Primary Examiner*—Carroll B. Dority

*Attorney, Agent, or Firm*—Wood, Phillips, Mason, Recktenwald & VanSanten

[57] ABSTRACT

In order to avoid carbon buildup and to assist fuel atomization, a fuel injection system (40) includes a fuel injector (42) associated with the upstream portion (44) of a combustor (10). The fuel injector (42) has a fuel flow passage (46) in communication with a source of fuel (14) and terminating in the upstream portion (44) of the combustor (10). The fuel injection system (40) also includes a primary oxidant delivery tube (20) associated with the upstream portion (44) of the combustor (10). The primary oxidant delivery tube (20) defines a primary oxidant flow passage (48) in communication with a source of oxidant (12) and terminating in the upstream portion (44) of the combustor (10). The fuel injection system (40) further includes a secondary oxidant delivery tube (50) associated with the upstream portion (44) of the conbustor (10). The secondary ocidant delivery tube (50) defines a secondary oxidant flow passage (52) in communication with the source of oxidant (12) and terminating in the upstream portion (44) of the combustor (10). The fuel injection system (44) is such that the fuel flow passage (46) is adapted to inject fuel from the source (14) into the upstream portion (44) of the combustor (10). The primary and secondary oxidant flow passages (48 and 52) are then adapted to deliver oxidant from the source (12) into the upstream portion (44) of the combustor (10) in surrounding relation to fuel injected through the fuel flow passage (46). With this arrangement, the secondary oxidant flow passage (52) is designed to assist in atomizing fuel injecting through the fuel flow passage (46) in a manner avoiding carbon buildup in the combustor (10).

13 Claims, 2 Drawing Sheets

STORED ENERGY COMBUSTOR FUEL INJECTION SYSTEM

FIELD OF THE INVENTION

The present invention is generally related to fuel injection systems and, more particularly, a fuel injection system for assisting fuel atomization to avoid carbon buildup.

BACKGROUND OF THE INVENTION

In stored energy combustors and other combustors, it is known that having a swirl stabilized flame is advantageous. For instance, this is true of a typical stored energy combustor wherein oxidant from a source is admitted to an oxidant delivery tube where it passes through a control valve on its way to a combustor in a rather precisely controlled manner. The oxidant passes through a sonic orifice which typically has a diffuser downstream so that pressure loss is minimized. From there, the oxidant is delivered to a combustor where fuel is injected for ignition with the oxidant. Downstream of the combustor, the hot gases of combustion pass through another sonic orifice into a turbine which is driven thereby.

With such an arrangement, the combustor is advantageously characterized by utilization of a swirl stabilized flame. Typical conditions just before and after ignition are such that combustion chamber pressure increases following combustion in a manner whereby the combustor pressure drop before ignition is many times higher than the combustor pressure drop after ignition. In like fashion, the air swirl velocity falls after ignition to a value only a fraction of the velocity before ignition.

Generally speaking, it is known that the combustor pressure drop before ignition must not be too great because the resulting high velocity would inhibit ignition. Similarly, the pressure drop after ignition would then be such that the resulting velocity would be very low, i.e., the velocity might possibly not be sufficient to air atomize fuel. As a result, it has generally been thought necessary to either use fuel pressure to atomize the fuel or otherwise suffer the consequences of carbon buildup.

The present invention is directed to overcoming one or more of the foregoing problems and accomplishing one or more of the resulting objectives.

SUMMARY OF THE INVENTION

It is a principal object of the present invention to provide an improved fuel injection system for a combustor. It is a further object of the present invention to provide a fuel injection system capable of assisting fuel atomization in a manner avoiding carbon buildup. It is a still further object of the present invention to provide a high air pressure system for fuel atomization.

To accomplish the foregoing, an exemplary embodiment of the fuel injection system includes a fuel injector associated with the upstream portion of a combustor. The fuel injector has a fuel flow passage in communication with a source of fuel and terminating in the upstream portion of the combustor for injecting fuel into the upstream portion of the combustor. The fuel injection system also includes primary and secondary oxidant delivery means associated with the upstream portion of the combustor which include respective primary and secondary oxidant flow passages in communication with a source of oxidant and terminating in the upstream portion of the combustor. The fuel injector is positioned such that the primary and secondary oxidant flow passages deliver oxidant from the source in surrounding relation to fuel injected through the fuel flow passage. With this arrangement, the fuel injection system includes means associated with the secondary oxidant flow passage to assist in atomizing fuel injected through the fuel flow passage in a manner avoiding carbon buildup.

In a preferred embodiment, the fuel flow passage includes means for swirling fuel injected into the upstream portion of the combustor. It is also advantageous for the primary and/or secondary oxidant flow passages to include means for swirling oxidant delivered to the upstream portion of the combustor. Preferably, the swirling means are swirl blades disposed to swirl fuel and oxidant in the same direction to enhance swirl momentum within the combustion chamber.

In this connection, the fuel atomizing assist means may therefore include swirl blades disposed in the secondary oxidant flow passage. It is also contemplated that the fuel atomizing assist means may include means for accelerating oxidant in the secondary oxidant flow passage. With either or both features, i.e., swirl blades and oxidant accelerating means, fuel atomization is enhanced and carbon buildup is avoided.

As will now be appreciated, the present invention contemplates a combustor which comprises a combustion chamber having an inlet end and an outlet end spaced therefrom. The fuel injection system is operatively associated with the inlet end of the combustion chamber. In addition to a fuel injector, the fuel injection system includes dual oxidant delivery means in the form of the primary and secondary oxidant flow passages.

With this understanding of the invention, the fuel flow passage is defined by a fuel injection tube terminating in fuel exit orifice means for injecting fuel into the combustion chamber centrally at the inlet end thereof in a generally conical spray path having a direction of flow generally toward the outlet end of the combustion chamber. It is also highly advantageous for the primary and secondary oxidant flow passages of the dual oxidant delivery means to be defined by concentric oxidant delivery tubes terminating at the inlet end of the combustion chamber and being disposed concentrically about the fuel flow passage for delivering oxidant into the combustion chamber along generally conical spray paths. With this arrangement, the generally conical oxidant spray paths cooperatively interact with the generally conical fuel spray path to atomize fuel by swirling fuel and oxidant in the same direction at a swirl angle of between approximately 40 to 60 degrees to enhance flow momentum within the combustion chamber.

In a stored energy combustor, the dual oxidant delivery means is such that the primary oxidant flow passage is defined by an oxidant delivery tube disposed concentrically about the fuel flow tube for delivering oxidant into the combustion chamber along a generally conical spray path. Still further, the dual oxidant delivery means is such that the secondary oxidant flow passage is defined by an oxidant diverter tube in communication with the oxidant delivery tube and disposed concentrically about the fuel flow tube for delivering oxidant into the combustion chamber along a generally conical spray path.

When so formed, the oxidant delivery tube and oxidant diverter tube both terminate at the inlet end of the combustion chamber. Further, the oxidant diverter tube advantageously is disposed radially inwardly of the oxidant delivery tube, i.e., intermediate the oxidant delivery tube and fuel tube. In a most preferred embodiment, fuel atomization is assisted by swirl blades disposed in the fuel injection tube, the oxidant delivery tube and the oxidant diverter tube.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
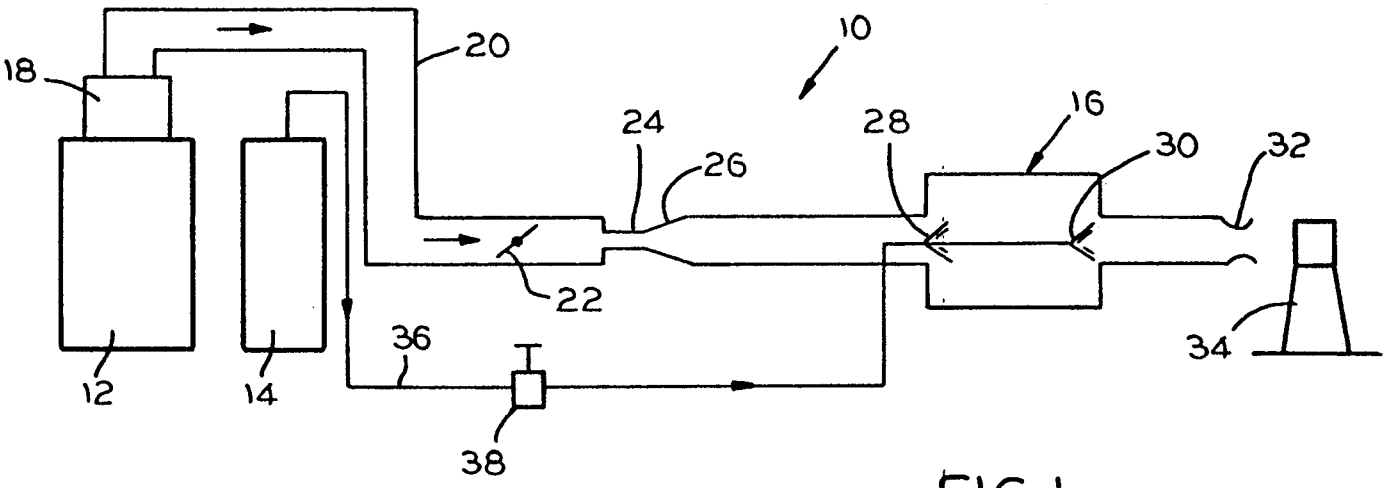
FIG. 1 is a schematic illustration of a typical stored energy combustor.

In the illustration given and with reference first to FIG. 1, the reference numeral 10 designates generally a typical stored energy combustor. The stored energy combustor 10 includes a source of oxidant as at 12, a source of fuel as at 14 and a combustor generally designated 16. Oxidant, typically either oxygen or air, passes through a pressure regulator 18 into an oxidant delivery tube 20 which delivers oxidant to the combustion chamber 16. It will be seen that the oxidant delivery tube 20 has a control valve 22 therein which enables precise control of oxidant flow following which the oxidant passes through a sonic orifice 24 which typically has a diffuser 26 downstream thereof to minimize pressure loss. Oxidant then passes into the combustion chamber 16 where fuel from the source 14 is injected in one or more stages as at 28 and 30. After the fuel and oxidant has been combusted, the hot gases of combustion pass through another sonic orifice 32 into a turbine 34.

Still referring to FIG. 1, fuel is delivered from the source 14 to the combustion chamber 16 through a fuel flow tube 36. It will be seen and appreciated that the fuel flow tube 36 will have another control valve such as 38 to optimize and control fuel flow. With this arrangement, the stored energy combustor 10 utilizes a swirl stabilized flame in a most advantageous manner.

However, because of different operating parameters before, during and after ignition, problems exist which may result in carbon buildup. While there is a high velocity at light off, at a later point following ignition low velocity may result in the buildup of carbon on the combustor wall inasmuch as fuel atomization becomes much more difficult. To avoid carbon buildup and to assist fuel atomization, the present invention provides a unique fuel injection system 40 as illustrated in FIGS. 2 and 3.

Figure 2:
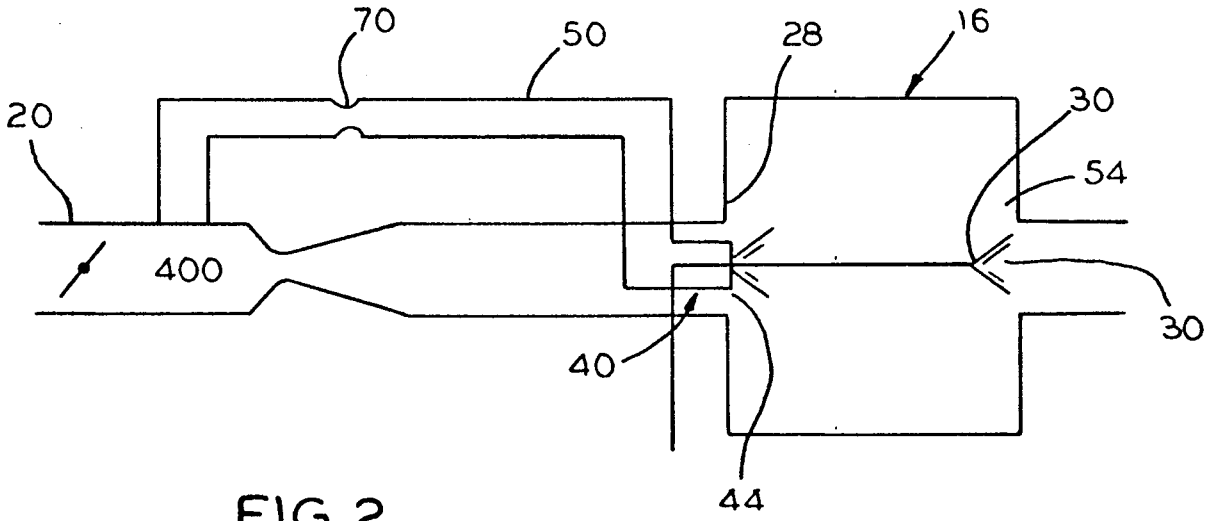
FIG. 2 is an enlarged schematic illustration of a portion of FIG. 1 showing an improved fuel injection system.
Figure 3:
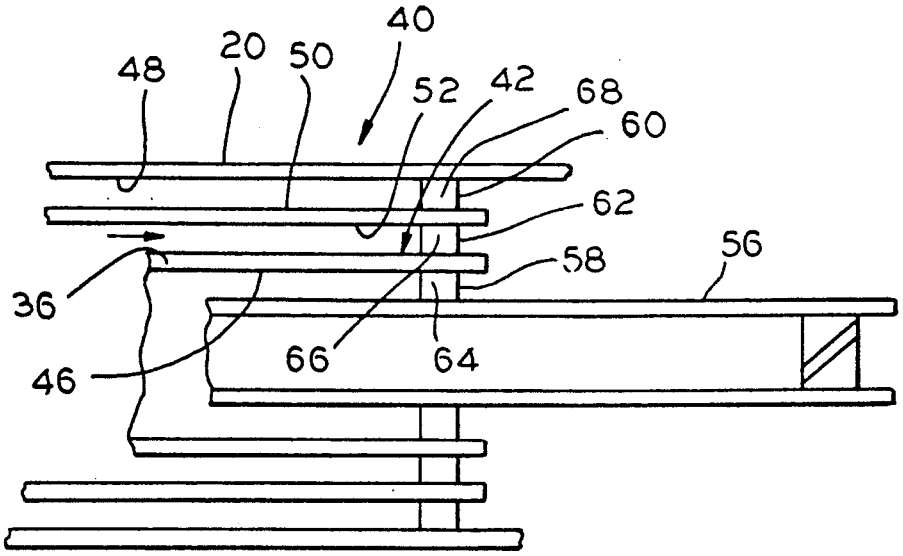
FIG. 3 is an enlarged cross sectional view of a portion of the fuel injection of FIG. 2.

Referring to FIGS. 2 and 3, the fuel injection system 40 includes a fuel injector 42 associated with the upstream portion or inlet end 44 of the combustion chamber 16. The fuel injector 42 has a fuel flow passage 46 defined by the fuel flow tube 36 which is in communication with the source of fuel 14 and terminates in the upstream portion or inlet end 44 of the combustor 10. The fuel injection system 40 also includes primary oxidant delivery means in the form of the oxidant delivery tube 20 associated with the upstream portion or inlet end 44 of the combustor 10. The oxidant delivery tube 20 defines a primary oxidant flow passage 48 which is in communication with the source of oxidant 12 and terminates in the upstream portion or inlet end 44 of the combustion chamber 16. The fuel injection system 40 further includes secondary oxidant delivery means or oxidant diverter tube 50 associated with the upstream portion or inlet end 44 of the combustion chamber 16. The oxidant diverter tube 50 defines a secondary oxidant flow passage 52 which is in communication with the source of oxidant 12 and terminates in the upstream portion or inlet end 44 of the combustion chamber 16. The fuel injector 42 is located such that the primary and secondary oxidant flow passages 48 and 52 deliver oxidant from the source 12 in surrounding relation to fuel injected through the fuel flow passage 46. With this arrangement, the fuel injection system 40 still further includes means associated with the secondary oxidant flow passage 52 to assist in atomizing fuel injected through the fuel flow passage 46 as will be described in greater detail hereinafter.

As will be appreciated from FIG. 2, the stored energy combustor 10 is formed such that the combustion chamber 16 has both an inlet end 44 and an outlet end 54. The fuel injection system 40 is operatively associated with the inlet end 44 of the combustion chamber 16, but may also have the second fuel injection stage 30 as previously described in connection with FIG. 1 wherein yet another fuel flow tube 56 passes concentrically through the fuel flow tube 36 to a point near the outlet end 54 of the combustion chamber 16. However, for present purposes, it is only necessary to describe the fuel injection system 40 independent of any other fuel flow tube such as 56.

Referring to FIGS. 2 and 3, it will now be appreciated that the fuel injection system 40 includes a fuel injector 42 and dual oxidant tubes 20 and 50, and the fuel injection tube 36 defining the fuel flow passage 46 has a fuel exit orifice as at 58 for injecting fuel centrally into the combustion chamber 16 in a generally conical spray path having a direction of flow generally toward the outlet end 54 of the combustion chamber 16. The oxidant delivery tube 20 defining the primary oxidant flow passage 48 is disposed concentrically about the fuel injection tube 36 for delivering oxidant into the combustion chamber 16 along a generally conical spray path also having a direction of flow generally toward the outlet end 54 of the combustion chamber 16. The oxidant diverter tube 50 defining the secondary oxidant flow passage 52 communicates with the oxidant delivery tube 20 upstream of the inlet end 44 of the combustion chamber 16 and is disposed concentrically about the fuel injection tube 36 for delivering oxidant into the combustion chamber 16 also along a generally conical spray path having a direction of flow generally toward the outlet end of 54 of the combustion chamber 16. As best shown in FIG. 3, the fuel injection tube 36, oxidant delivery tube 20 and oxidant diverter tube 50 all terminate at the inlet end 44 of the combustion chamber 16 where the oxidant diverter tube 50 is disposed radially inwardly of the oxidant delivery tube 20 and radially outwardly of the fuel injection tube 36, i.e., intermediate the oxidant delivery tube 20 and fuel injection tube 36.

With this arrangement, the generally conical oxidant spray paths cooperatively interact to atomize fuel in the generally conical fuel spray path. It will be appreciated that this occurs because of the concentric and adjacent nature of the fuel exit orifice 58 and oxidant orifices 60 and 62 of the oxidant delivery tube 20 and oxidant diverter tube 50, respectively. In addition, fuel atomization is assisted by means associated with at least one of the fuel and oxidant flow passages 46, 48 and 52.

In particular, the fuel atomizing assist means may include means such as swirl blades 64 which are provided for swirling fuel as it is injected into the combustion chamber 16. It may also include means such as swirl blades 66 and/or 68 for swirling oxidant delivered to the combustion chamber 16. Preferably, the fuel atomizing assist means includes all of swirl blades 64, 66 and 68 disposed in the respective fuel injection tube 36, oxidant delivery tube 20 and oxidant diverter tube 50.

Alternatively, or as an additional fuel atomizing assist, means may be provided for accelerating oxidant in the oxidant diverter tube 50. It will be seen in FIG. 2 that a restricting orifice 70 may be provided to give a pressure drop so as to optimize the pressure and velocity of oxidant delivered to the fuel injection system 40 through the oxidant diverter tube 50. By diverting a small portion of the total oxidant flow, e.g., approximately 10% more or less, fuel atomization is greatly enhanced.

Referring once again to FIG. 3, the swirl blades 64, 66 and 68 are advantageously disposed to swirl fuel and oxidant in the same direction. This serves to enhance swirl momentum within the combustion chamber 16 with the swirl blades preferably being disposed at a swirl angle of between approximately 40 to 60 degrees. Because the swirl momentum is proportionately higher, the combustion process is facilitated to provide an efficient, clean burning flame.

Figure 4:
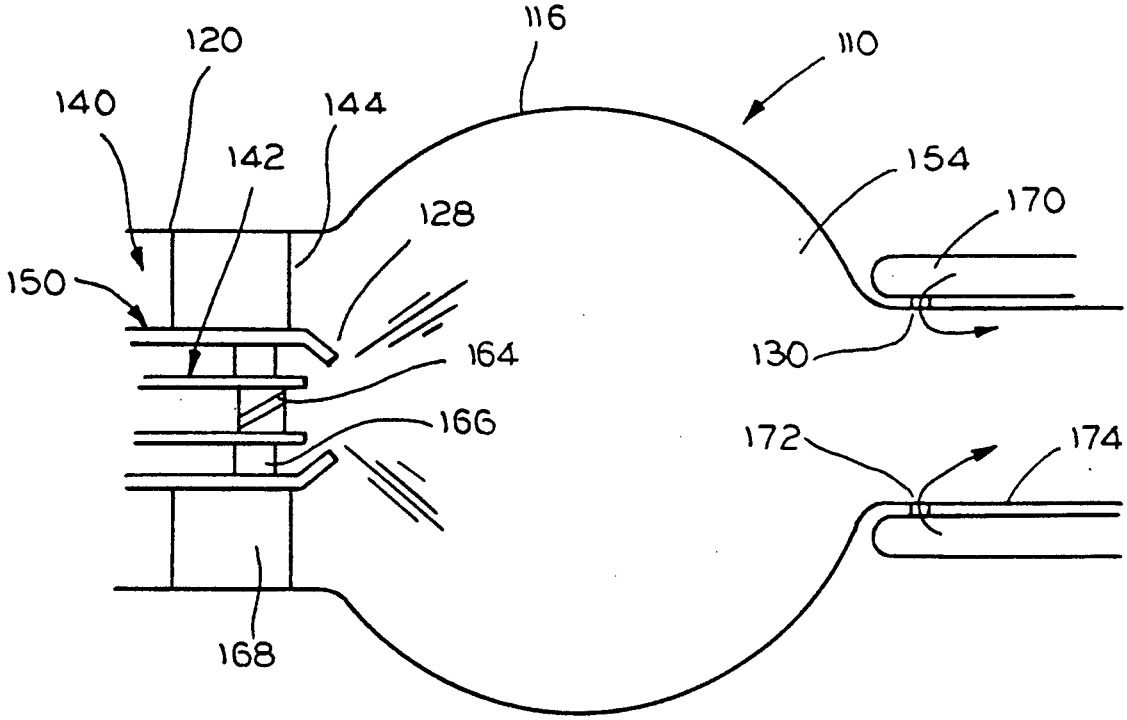
FIG. 4 is a largely schematic cross sectional view of yet another combustor utilizing the fuel injection system of the present invention.

Referring to FIG. 4, the reference numeral 110 designates generally another combustor utilizing the unique features of the present invention. The combustor 110 includes a combustion chamber 116 having an inlet end 144 and an outlet end 154. A fuel injection system generally designated 140 and having a fuel injector 142 is operatively associated with the inlet end 144 of the combustion chamber 116. The fuel injector 142 is preferably concentrically surrounded by an oxidant delivery tube 120 and an oxidant diverter tube 150. Still further, the combustor 110 may utilize swirl blades 164, 166 and 168 as previously described in connection with FIG. 3.

As will be appreciated, the illustrated components in the combustor 110 may be similar or identical to the corresponding components of the combustor 10 (see FIGS. 1 through 3). In addition, while the fuel injection system 140 may comprise a first fuel injection stage 128 corresponding to the first fuel injection stage 28 illustrated in FIGS. 1 and 2, the second fuel injection stage 130 may be entirely independent of the fuel injection system 140. As a result, a second fuel flow tube 170 may be provided to delivery fuel to suitable orifices as at 172 in a narrowed wall 174 just downstream of the outlet end 154 of the combustion chamber 116.

By way of example and not limitation, typical conditions at ignition for the stored energy combustor 10 illustrated in FIG. 1 might be static pressures of 400 psi just upstream of the sonic orifice 24, 200 psi at the sonic orifice 24, 103 psi downstream of the diffuser 26, and 100 psi upstream of the sonic orifice 32. The resulting static pressures after ignition, by virtue of the fact that the sonic orifice 24 is choked thereby providing a constant gas flow, would typically be approximately 400 psi just upstream of the sonic orifice 24, 200 psi at the sonic orifice 24, approximately 300.5 psi just downstream of the diffuser 26, and 300 psi upstream of the sonic orifice 32. Using these pressures for illustration, it will be seen that the pressure has increased in the combustion chamber 16 from approximately 100 psi to approximately 300 psi as a result of ignition and, as a result, the pressure drop before ignition is approximately nine times higher than the pressure drop after ignition by virtue of the following:

$$\frac{\left(\frac{\Delta P_1}{P}\right)_1}{\left(\frac{\Delta P_2}{P}\right)_2} = \left(\frac{400-100}{400-300}\right)^2 = \left(\frac{300}{100}\right)^2 = \frac{9}{1} = 9$$

Furthermore, the swirl velocity falls after ignition to a value only about ⅓ the swirl velocity before ignition.

Typically, the pressure drop before ignition must not be too high in order to avoid high velocities inhibiting ignition. Thus, the pressure drop before ignition might typically be approximately 3% (i.e., a drop of from 103 psi to 100 psi in the above example) which would mean that the pressure drop after ignition would be only about 0.33% (i.e., 1/9 of three percent) and the resulting velocities after ignition would be very low to the point of being insufficient to air atomize fuel. As will now be appreciated, it is an achievement of the present invention to overcome the deleterious effects of such low velocities.

As previously mentioned, a small portion of the total oxidant flow, e.g., approximately 10% more or less, will be diverted through the oxidant diverter tube 50 in FIG. 2. The oxidant diverter tube 50 may have a restricting orifice 70 that takes a pressure drop so as to better optimize the pressure of oxidant delivered to the fuel injection system 40. With this understanding, the parameters of the above example are most illuminating as the following will illustrate.

Before ignition, the pressure drop across the fuel injection system 40 by way of the oxidant diverter tube 50 (assuming no restrictive orifice 70) will be as follows:

$$\frac{\Delta P}{P} = \frac{400-100}{100} \times 100 = 300\%$$

After ignition, the pressure drop across the fuel injection system 40 by way of the oxidant diverter tube 50 (again assuming no restrictive orifice 70) will be as follows:

$$\frac{\Delta P}{P} = \frac{400-300}{300} \times 100 = 33\%$$

Typically, it has been found that values of $\Delta P/P$ after ignition of between about 15% and 33% are suitable to avoid deleterious effects on ignition.

For the above parameters, the velocity after ignition may be determined approximately by suitable equations assuming typical ambient temperatures to be on the order of 782 feet per second. This is more than adequate to atomize the primary fuel flow through the fuel injector 42. In comparison, without the fuel injection system 40 of the present invention, the velocity across a conventional fuel injector under the same general parameters using suitable equations will be approximately on the order of 1/10 that amount, i.e., 78.2 feet per second.

From the foregoing, it can now be seen that the velocity of approximately 90% of the oxidant, i.e., the oxidant passing through the oxidant delivery tube 20, would be approximately 78.2 feet per second. In like fashion, the velocity of the remaining 10% of the oxidant, i.e., the oxidant passing through the oxidant diverter tube 50, would be approximately 782 feet per second. By utilizing suitable equations, it can be determined that the swirl momentum of the oxidant entering the combustion chamber 16 will be nearly twice as great utilizing the features of the present invention.

As will now be appreciated, the present invention provides a convenient, simple means of atomizing fuel while at the same time providing substantially more swirl momentum. The proportionately higher swirl momentum enhances the combustion process in providing an efficient, clean burning flame. In addition, a combustor can operate with good combustion over a very wide range of power levels, i.e., from high to low fuel flows, with no difficulties.

Without the present invention, and utilizing only fuel pressure atomization, the range of power levels would be severely limited. This follows because, at high power, the fuel pressure would be excessively high and at low power the fuel pressure would not suffice to give good fuel atomization. Clearly, this is still another indication of the significance of what has been achieved by the present invention.

Referring to FIG. 2, a still further alternative would be to substitute a constant pressure ratio regulator for the restricting orifice 70. Then, the pressure ratio across the exit orifice 62 of the oxidant diverter tube 50 would be kept more or less constant before, during and after ignition. As a result, excessive pressure ratios across the exit orifice 62 during and before ignition could be avoided to still further enhance ignition reliability.

While in the foregoing there have been set forth preferred embodiments of the invention, it will be appreciated that the details herein given may be varied by those skilled in the art without departing from the true spirit and scope of the appended claims.

We claim:

1. A fuel injection system for a combustor having an upstream portion and a downstream portion comprising:

a fuel injector associated with said upstream portion of said combustor, said fuel injector having a fuel flow passage in communication with a source of fuel, said fuel flow passage terminating in said upstream portion of said combustor and including means for swirling fuel injected into said upstream portion of said combustor;

primary oxidant delivery means associated with said upstream portion of said combustor, said primary oxidant delivery means including a primary oxidant flow passage in communication with a source of oxidant for delivering a major portion of said oxidant in said combustor, said primary oxidant flow passage terminating in said upstream portion of said combustor;

secondary oxidant delivery means associated with said upstream portion of said combustor, said secondary oxidant delivery means including a secondary oxidant flow passage for delivering a minor portion of said oxidant to said combustor, said secondary oxidant flow passage terminating in said upstream portion of said combustor;

oxidant diverter means for diverting said minor portion of said oxidant from said primary oxidant flow passage to said secondary oxidant flow passage;

oxidant accelerating means for accelerating oxidant in said secondary oxidant flow passage to a higher velocity substantially independent of the velocity of oxidant in said primary oxidant flow passage and substantially independent of pressure in said combustor; and oxidant swirling means in said second oxidant flow passage downstream of said oxidant acceleration means for swirling oxidant delivered to said upstream portion of said combustor.

2. The fuel injection system of claim 1 wherein said primary oxidant flow passage includes means for swirling oxidant delivered to said upstream portion of said combustor.

3. The fuel injection system of claim 1 wherein said primary and secondary oxidant flow passages are concentrically disposed about said fuel flow passage.

4. A fuel injection system for a combustor having an upstream portion and a downstream portion, comprising:

a fuel injector associated with said upstream portion of said combustor, said fuel injector having a fuel flow passage in communication with a source of fuel, said fuel flow passage terminating in said upstream portion of said combustor;

primary oxidant delivery means associated with said upstream portion of said combustor, said primary oxidant delivery means including a primary oxidant flow passage in communication with a source of oxidant for delivering a major portion of said oxidant in said combustor, said primary oxidant flow passage terminating in said upstream portion of said combustor;

secondary oxidant delivery means associated with said upstream portion of said combustor, said secondary oxidant delivery means including a secondary oxidant flow passage for delivering a minor portion of said oxidant to said combustor, said secondary oxidant flow passage terminating in said upstream portion of said combustor, said primary and secondary oxidant flow passages being concentrically disposed about said fuel flow passage with said secondary oxidant flow passage disposed between said fuel flow passage and said primary oxidant flow passage;

oxidant diverter means for diverting said minor portion of said oxidant from said primary oxidant flow passage to said secondary oxidant flow passage;

oxidant accelerating means for accelerating oxidant in said secondary oxidant flow passage to a higher velocity substantially independent of the velocity of oxidant in said primary oxidant flow passage and substantially independent of pressure in said combustor; and oxidant swirling means in said second oxidant flow passage downstream of said oxidant acceleration means for swirling oxidant delivered to said upstream portion of said combustor.

5. A combustor comprising:

a combustion chamber having an inlet end and an outlet end, said combustion chamber having a fuel injection system operatively associated with said inlet end thereof, said fuel injection system including a fuel injector and dual oxidant delivery means;

said fuel injector having a fuel flow passage in communication with a source of fuel, said fuel flow passage being defined by a fuel injection tube terminating in fuel exit orifice means for injecting fuel into said combustion chamber centrally at said inlet end thereof in a generally conical spray path, said generally conical spray path having a direction of flow generally toward said outlet end of said combustion chamber;

said dual oxidant delivery means including primary and secondary oxidant flow passages in communication with a source of oxidant, said primary and secondary oxidant flow passages being defined by concentric oxidant delivery tubes terminating at said inlet end of said combustion chamber and being disposed concentrically about said fuel flow passage for delivering a major portion and a minor portion, respectively, of oxidant into said combustion chamber along generally conical spray paths, said generally conical oxidant spray paths cooperatively interacting with said generally conical fuel spray to atomize fuel;

means for accelerating oxidant in said secondary oxidant flow passage to a higher velocity substantially independent of the velocity of oxidant in said primary oxidant flow passage and substantially independent of pressure in said combustor; and means associated with said oxidant and fuel flow passages for further assisting in atomizing fuel, said fuel atomizing assist means includes swirl blades disposed in said fuel injection tube and said oxidant delivery tubes;

whereby at least said oxidant from said secondary oxidant flow passage is accelerated upstream of said fuel atomizing assist means and interacts with said fuel from said fuel flow passage to cause fuel atomization in said combustor.

6. The combustor of claim 5 wherein said secondary oxidant flow passage is disposed between said fuel flow passage and said primary oxidant flow passage.

7. The combustor of claim 5 wherein said swirl blades are disposed to swirl fuel and oxidant in the same direction to enhance swirl momentum within said combustion chamber.

8. The combustor of claim 7 wherein said swirl blades are disposed at a swirl angle of between approximately 40 to 60 degrees.

9. A stored energy combustor, comprising:

a combustion chamber having an inlet end and an outlet end, said combustion chamber having a fuel injection system operatively associated with said inlet end thereof, said fuel injection system including a fuel injector and dual oxidant delivery means;

said fuel injector having a fuel flow passage in communication with a source of fuel, said fuel flow passage being defined by at least one fuel injection tube terminating in fuel exit orifice means for injecting fuel into said combustion chamber centrally at said inlet end thereof in a generally conical spray path, said generally conical spray path having a direction of flow generally toward said outlet end of said combustion chamber;

said dual oxidant delivery means including primary and secondary oxidant flow passages in communication with a source of oxidant, said primary oxidant flow passage being defined by an oxidant delivery tube terminating at said inlet end of said combustion chamber and being disposed concentrically about said fuel flow tube for delivering oxidant into said combustion chamber along a generally conical spray path, said secondary oxidant flow passage being defined by an oxidant diverter tube in communication with said oxidant delivery tube upstream of said inlet end of said combustor and having a portion disposed concentrically about said fuel flow tube for delivering oxidant into said combustion chamber along a generally conical spray path, said oxidant diverter tube also terminating at said inlet end of said combustion chamber radially inwardly of said oxidant delivery tube;

said primary and secondary oxidant flow passages being adapted to deliver a major portion and a minor portion, respectively, of oxidant into said combustion chamber along said generally conical spray paths, said generally conical oxidant spray paths cooperatively interacting with said generally conical fuel spray path to atomize fuel;

means for accelerating oxidant in said secondary oxidant flow passage to a higher velocity substantially independent of the velocity of oxidant in said primary oxidant flow passage and substantially independent of pressure in said combustor; and means associated with at least one of said oxidant and fuel flow passages for further assisting in atomizing fuel, said fuel atomizing assist means includes swirl blades disposed in said secondary oxidant flow passage and fuel injection tube;

whereby at least said oxidant from said secondary oxidant flow passage is accelerated upstream of said fuel atomizing assist means and interacts with said fuel from said fuel flow passage to cause fuel atomization in said combustor.

10. The stored energy combustor of claim 9 wherein said further fuel atomizing assist means includes means for accelerating oxidant in said oxidant diverter tube.

11. A stored energy combustor, comprising:

a combustion chamber having an inlet end and an outlet end, said combustion chamber having a fuel injection system operatively associated with said inlet end thereof, said fuel injection system including a fuel injector and dual oxidant delivery means;

said fuel injector having a fuel flow passage in communication with a source of fuel, said fuel flow passage being defined by at least one fuel injection tube terminating in fuel exit orifice means for injecting fuel into said combustion chamber centrally at said inlet end thereof in a generally conical spray path, said generally conical spray path having a direction of flow generally toward said outlet end of said combustion chamber;

said dual oxidant delivery means including primary and secondary oxidant flow passages in communication with a source of oxidant, said primary oxidant flow passage being defined by an oxidant delivery tube terminating at said inlet end of said combustion chamber and being disposed concentrically about said fuel flow tube for delivering oxidant into said combustion chamber along a generally conical spray path, said secondary oxidant flow passage being defined by an oxidant diverter tube in communication with said oxidant delivery tube upstream of said inlet end of said combustor and having a portion disposed concentrically about said fuel flow tube for delivering oxidant into said combustion chamber along a generally conical spray path, said oxidant diverter tube also terminating at said inlet end of said combustion chamber radially inwardly of said oxidant delivery tube;

said primary and secondary oxidant flow passages being adapted to deliver a major portion and a minor portion, respectively, of oxidant into said combustion chamber along said generally conical spray paths, said generally conical oxidant spray paths cooperatively interacting with said generally conical fuel spray path to atomize fuel;

means for accelerating oxidant in said secondary oxidant flow passage to a higher velocity substantially independent of the velocity of oxidant in said primary oxidant flow passage and substantially independent of pressure in said combustor; and means associated with at least one of said oxidant and fuel flow passages for further assisting in atomizing fuel, said fuel atomizing assist means includes swirl blades disposed in said fuel injection tube and said oxidant delivery and diverter tubes;

whereby at least said oxidant from said secondary oxidant flow passage is accelerated upstream of said fuel atomizing assist means and interacts with said fuel from said fuel flow passage to cause fuel atomization in said combustor.

12. The stored energy combustor of claim 11 wherein said swirl blades are disposed to swirl fuel and oxidant in the same direction to enhance swirl momentum within said combustion chamber.

13. The stored energy combustor of claim 12 wherein said swirl blades are disposed at a swirl angle of between approximately 40 to 60 degrees.

* * * * *